United States Patent [19]

Diaz

[11] Patent Number: 4,992,074

[45] Date of Patent: Feb. 12, 1991

[54] REUSABLE SELF-SUPPORTING BRASSIERE

[75] Inventor: Amanda Diaz, Burbank, Calif.

[73] Assignee: Damin Industries, Inc., Los Angeles, Calif.

[21] Appl. No.: 359,983

[22] Filed: Jun. 1, 1989

[51] Int. Cl.[5] ..... A41C 3/00; A41C 3/14

[52] U.S. Cl. ..... 450/81; 450/54; 450/55; 450/57; 2/267

[58] Field of Search ..... 450/54, 55, 56, 57, 450/81; 2/267

[56] References Cited

U.S. PATENT DOCUMENTS

| | | | |
|---|---|---|---|
| 2,596,567 | 5/1952 | Langs | 2/42 |
| 2,664,571 | 1/1954 | Kempel | 450/57 |
| 2,728,079 | 12/1955 | Williams | 450/81 |
| 2,834,352 | 5/1958 | Ullian | 450/57 |
| 2,869,553 | 1/1959 | D'Or | 450/81 |
| 3,200,413 | 8/1965 | Vaughan | 2/60 |
| 3,221,748 | 12/1965 | Glasser | 450/81 X |
| 3,280,818 | 10/1966 | Pankey et al. | 128/505 |
| 3,297,036 | 1/1967 | Williams | 450/81 |
| 3,620,222 | 11/1971 | Block | 450/57 |
| 3,807,412 | 4/1974 | Connelly | 450/57 |
| 3,934,593 | 1/1976 | Mellinger | 128/480 |
| 4,343,313 | 8/1982 | Le Jeune | 450/39 |
| 4,816,004 | 3/1989 | Emanuel | 450/57 |

FOREIGN PATENT DOCUMENTS

| | | | |
|---|---|---|---|
| 1042487 | 11/1958 | Fed. Rep. of Germany | 450/57 |
| 2161451 | 6/1972 | Fed. Rep. of Germany . | |
| 2818162 | 12/1978 | Fed. Rep. of Germany . | |
| 2505620 | 11/1982 | France . | |

*Primary Examiner*—Werner H. Schroeder
*Assistant Examiner*—Jeanette E. Chapman
*Attorney, Agent, or Firm*—Spensley Horn Jubas & Lubitz

[57] ABSTRACT

A soft, reusable, self-supporting bra is disclosed. The bra is comprised of two independent shaped forms having a plastic foam construction and are formed so as to have the desired shape. The forms may be worn underneath a conventional bra or bathing suit and are completely washable. Self-adhesive strips are included to hold the bra forms to the wearer. The strips are cut so as to overlay part of the bra, holding the bra forms in place without adhering to the wearer's breast skin.

10 Claims, 1 Drawing Sheet

REUSABLE SELF-SUPPORTING BRASSIERE

BACKGROUND OF THE INVENTION

1. Field of the Invention

This invention relates to articles of clothing, and more particularly to women's undergarments for supporting the breasts, known as brassieres or bras.

2. Description of the Related Art

Fashionable clothing for women often include low-cut necklines or backless and strapless designs. Strapless undergarments and bras have been designed for use with such fashions. Such designs frequently incorporate adhesives that are an integral part of the bra. This is shown, for example, in U.S. Pat. No. 3,934,593. Unfortunately, this makes the bras very short lived, because the adhesive qualities of the integral adhesive are quickly diminished with wear. Each removal and replacement of the bra greatly reduces the adhesive quality and therefore severely limits the useful life of the bra. Often, such bras are disposable and may only be used once. In addition, such bras cannot be washed without destroying the adhesive layer. Other bras incorporate an adhesive layer that must be attached directly to the skin of the breast area. This skin is sensitive and may be easily irritated by the adhesive.

Often the shape of conventional strapless bras severely limits the manner in which such bras may be worn. For example, U.S. Pat. No. 2,596,567 shows a bra that completely covers the breast. Such a design cannot be worn with low-cut dresses. Similarly, U.S. Pat. No. 3,280,818 incorporates two independent cup-shaped support elements with flange portions along their lower edge that extend directly below the breasts and toward the center of the wearer's chest. This design cannot be worn with many plunging neckline fashions because the flange portions may be visible along the neckline, extending beyond the edge of the garment. The size of these two designs also makes it impractical or uncomfortable to wear them with a conventional bra or a bathing suit. Finally, many conventional strapless bras are constructed of several different materials, including coverings, padding, and fasteners. This increases production steps and costs, and generally reduces comfort and mobility when the bras are worn.

SUMMARY OF THE INVENTION

The present invention provides a reusable, self-supporting bra that supports, lifts, and supplements the wearer's breasts. The bra of the present invention may be worn with low-cut, backless, strapless, and other revealing fashions while providing maximum freedom of movement for the wearer. The bra of the present invention is washable and reusable. The bra may be worn inside a conventional bra or placed in a bathing suit for additional shaping.

The bra of the present invention includes two self-supporting forms, one for each breast, that lift and support the breasts. The bra of the present invention also may be shaped so as to provide additional padding to supplement the wearer's breasts, thereby increasing their apparent size and providing a smooth shape. The self-supporting forms of the present invention do not completely cover the breasts. Rather, the forms have a back surface that defines an open breast-receiving pocket. Each form extends beneath the breast, around the nipple, and over a portion of the top of the breast. The front surface of the bra form is given a shape consistent with the wearer's natural contours, thus providing a smoother, more natural appearing shape. Thus, the forms may be positioned under each breast for maximum lift and support. Alternatively, the forms may be rotated outwardly toward the wearer's arms for low-cut dresses or for accentuating cleavage.

The bra of the present invention may include adhesive strips that overlay a part of the self-supporting bra forms and the skin of the wearer. The adhesive strips and bra forms are constructed such that none of the adhesive need touch the skin of the actual breast area, reducing the chances of skin irritation. The bra forms are washable and may be reused. The adhesive strips allow the bra forms to be positioned and securely located on the wearer to achieve the desired effects. The open cup design of the forms and the adhesive strips allow the forms to be positioned on the wearer so they cannot be seen beyond the garment, and make the bra of the present invention ideal for use with plunging neckline fashions. The adhesive strips allow the bra forms to support and lift the breasts and hold them securely in place without significantly reducing the wearer's freedom of movement. The bra forms are constructed of a soft homogeneous material, such as plastic foam. This provides the back surface, which comes in contact with the breasts, with a soft, comfortable feel. The front surface of the bra forms may be given a more firm surface, in order to provide the shape and smoothness desired.

DETAILED DESCRIPTION OF THE PREFERRED EMBODIMENT

The following description is of the best presently contemplated mode of carrying out the invention. This description is made for the purpose of illustrating the general principles of the invention and should not be taken in a limiting sense. The scope of the invention is best determined by reference to the appended claims. In the accompanying drawings, like numerals designate like parts in the several figures.

Figure 1:
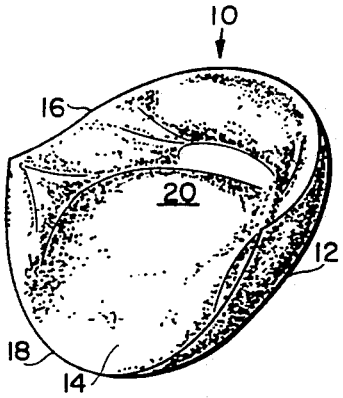
FIG. 1 shows a perspective view of the back side of the preferred embodiment of the present invention.
Figure 2:
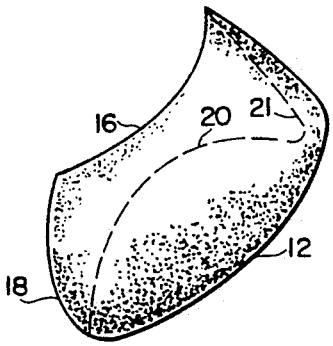
FIG. 2 shows a side view of the preferred embodiment of the present invention.

FIG. 1 shows a perspective view of the preferred embodiment of the present invention, from its back side. FIG. 2 shows a side view of the preferred embodiment. The preferred embodiment comprises a self-supporting shaped form 10 having a front surface 12 and a back surface 14. Two identically shaped forms are used, one for each breast. Different sized forms may be provided for different sized breasts. For example, a bra for use by someone with an A/B conventional bra cup size would be approximately 5 inches across at its greatest width. The form 10 does not completely cover the breast, but leaves a top portion of it exposed. This allows the bra to be used with low-cut, revealing fashions, provides maximum flexibility of positioning on the wearer, and allows it to be used with a wide variety of conventional bras and bathing suits.

The form 10 has a top edge 16 and a bottom edge 18. The front surface 12 is shaped so as to provide the desired contour consistent with the lifting, supporting, and supplementing functions of the bra.

In the preferred embodiment, the form has a homogeneous construction of a material such as, for example, plastic foam. This provides a form with the required support that is also lightweight and comfortable for the wearer. Preferably, the front surface 12 of the form is provided with a somewhat firmer and smoother surface finish when compared with the back surface 14, for a smoother outer appearance when worn while still being comfortable for the wearer. The front surface finish may be provided by a surface coating on the form or by the finish of the mold used to produce the form, as will be understood by those skilled in the art.

The back surface 14 of the form is shaped into an open, breast-receiving pocket. The back surface 14 includes an upwardly extending front wall 19 and a ledge 20 extending rearwardly away from the front surface 12. In the preferred embodiment comprising plastic foam, the ledge 20 appears in side view at a portion of the form 10 having an increased thickness, as illustrated in FIG. 2. A thin portion 21 of the form covers the nipple area, while the ledge 20 fits directly under the bottom of the breast. Thus, the breast lays on top of the ledge 20. The ledge 20 lifts and supports the breast while the wall 19 adds a degree of padding over a top portion of the breast. Together, they help to increase the apparent size of the breast. The illustrated embodiment adds one full bra cup size in appearance, for example, from a "B" cup to a "C" cup. The thickness of the form 10 may be adjusted in accordance with the amount of lift and padding desired.

Figure 3:
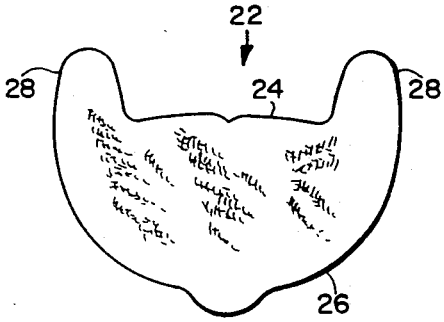
FIG. 3 shows the adhesive strip of the present invention.
Figure 4:
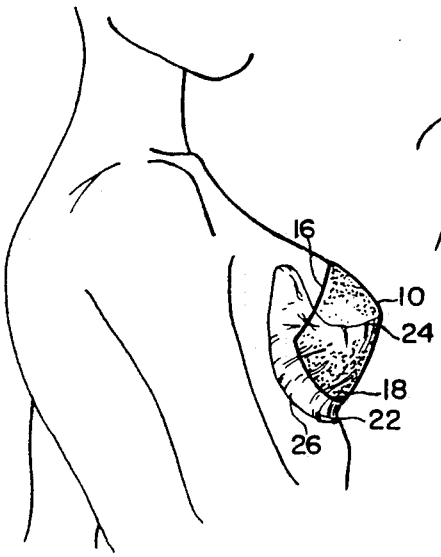
FIG. 4 shows the present invention illustrating the manner in which it is typically worn.
Figure 5:
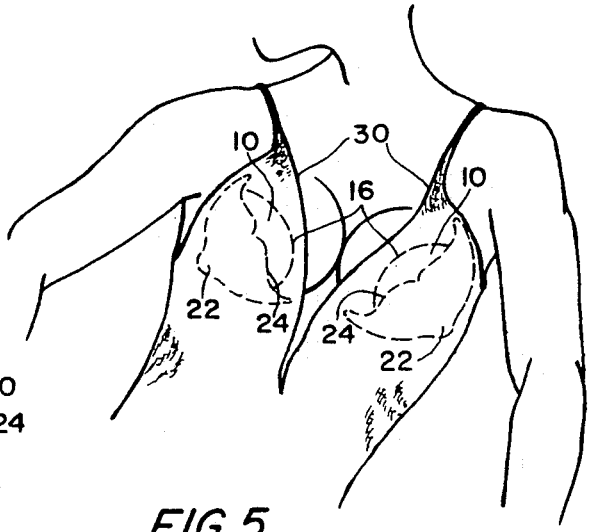
FIG. 5 shows the present invention illustrating the manner in which it may be worn with plunging neckline fashions.

FIG. 3 shows a self-adhesive strip 22, or wing, that may be used in conjunction with the form 10. The self-adhesive wing 22 may be used to position the form 10 as desired and hold it in place on the wearer's body. The wing 22 has a generally straight top edge 24 and a curved bottom edge 26, with an extending tab 28 at each end of the wing. The wing is used to overlay a part of the form 10 along the top edge 24, and to overlay the wearer's skin along the bottom edge 26. The shape of the wing is specially adapted for holding the form to the body, as illustrated in FIG. 4 and FIG. 5. In the preferred embodiment, the self-adhesive strips are approximately 8½ inches long, from tab to tab, and approximately 5 inches from top edge 24 to bottom edge 26. One surface of the wing is provided with an adhesive layer covered by a backing.

The wing 22 may be constructed of any smooth, pliable material, such as cotton or nylon. In the preferred embodiment, the self-adhesive wing 22 is made from a fabric known as tricote'. This is a finely woven material having a grain. Tricote' has the desirable property of stretching evenly, without wrinkling. The wing 22 is cut from the tricote' fabric such that the grain is oriented diagonally, on a bias. That is, the grain may be said to run from the upper right corner of the wing to the lower left corner and from the upper left corner to the lower right corner of the wing. This allows the wing 22 to stretch evenly and smoothly, without wrinkles, even when it is placed on the wearer.

When the self-adhesive wing is to be used, the backing may be removed, exposing the adhesive layer. Although the adhesive is tacky to the touch, it will not securely and firmly attach to a surface until it is smoothed and pressed firmly against the surface. This allows for some degree of trial and error in attempting various placements of the self-adhesive strip 22, prior to pressing and smoothing.

After the backing is removed, a portion of the wing 22 is pressed onto the front surface 12 of the form 10 approximately two inches from the top edge 16 of the form. The wing is then smoothed onto the front surface 12, eliminating as many wrinkles and air pockets as possible that are otherwise trapped by the wing. The bottom edge 26 of the self-adhesive wing extends approximately 1½ to 2 inches beyond the bottom edge 18 of the form. The form 10 may then be placed in position on the wearer. The bottom part of the wing is then firmly pressed onto the skin with one hand and the rest of the wing may be smoothed and pressed onto the skin with the other hand. The tab ends 28 of the wings should be smoothed onto the skin last.

FIG. 4 is a side view of the form 10 and adhesive wing 22 of the present invention in position as typically worn. The top edge 24 of the adhesive wing is located approximately two inches below the top edge 16 of the form 10. The bottom edge 26 of the adhesive wing extends approximately two inches from the bottom edge 18 of the form 10. FIG. 4 illustrates that the adhesive wing 22 does not come in contact with the skin of the breast itself, but rather extend onto the wearer's chest. This reduces the likelihood of skin irritation. After the adhesive wings have been used, they may be discarded. Additional wings may then be separately obtained for subsequent use with the bra forms 10. This allows the forms 10 to be washed and used again and again, replacing only the relatively inexpensive wings 22 with each use.

FIG. 5 shows the form 10 and adhesive wing 22 as typically located for use with low-cut garments 30 having plunging necklines. FIG. 5 illustrates that the forms 10 may be rotated from their usual position directly under the breasts, as illustrated in FIG. 4, and angled to the sides of the user. Because the forms 10 are flexible and are held in place by the adhesive wings, the bra of the present invention may be worn in the manner illustrated in FIG. 5 while still being comfortable and without any great loss of movement for the wearer. The tab ends 28 of the adhesive wings 22 may be trimmed as necessary for them to remain hidden behind the outer garment 30.

The bra of the present invention provides a self-supporting form giving lift and support for the breasts while also adding to their apparent size. The bra is reusable and washable, and may be used in conjunction with conventional bras and bathing suits. The bra is ideally suited for use with backless, strapless, and low-cut fashions. The bra includes self-adhesive wings that may be used with the shaped forms of the bra to securely locate the forms in the desired position. The self-adhesive wings provide extra versatility in positioning the forms without decreasing freedom of movement and comfort for the user. The wings are relatively inexpensive and may disposed of after use.

What I claim is:

1. A backless, strapless bra comprised of:

a resuable, self-supporting shaped form constructed of a flexible homogeneous material having a front surface and a back surface, the front surface having a generally rounded, smooth contour and the back surface forming an open breast receiving pocket having a shelf-life supporting ledge that comes into contact with the bottom of the breast; and an adhesive strip cut into a winged shape having an adhesive layer on one surface, such that when the adhesive layer is exposed and the shaped form is placed on the wearer, the strip may overlay a portion of the form and attach to the skin of the wearer, holding the form in place.

2. The bra according to claim 1, wherein the adhesive strip is stretchable.

3. A bra comprising:

a shaped form having a convex front surface with a top edge and a bottom edge having common endpoints, and a compound curved back surface, the top portion of the back surface having a concave shape and bottom portion of the back surface having a lower convex shape.

4. The bra according to claim 3 wherein the self-adhesive strip is constructed from a resilient fabric having a stretchable weave.

5. The bra according to claim 4, wherein the resilient fabric has a grain and the strip is constructed such that the grain runs diagonally between the strip top edge and bottom edge.

6. A kit for assembling a backless and strapless brassiere comprising:

a pair of separate forms, each form having a rounded exterior surface shaped to conform generally to the shape of a portion of a breast, and each form further defining an interior pocket adapted to receive and support a breast; and a pair of separate adhesive strips for independently securing each form about a breast of a wearer, each strip having an adhesive surface adapted to adhere directly to the rounded breast-shaped exterior surface of a form and to the chest of the wearer, said adhesive surface having an enlarged central portion sized sufficiently to cover a substantial portion of the rounded breast-shaped exterior surface of the form, and tab portions to extend beyond the form to adhere to the wearer's chest.

7. A kit as claimed in claim 6, wherein the forms have a variety of different sizes.

8. A kit as claimed in claim 6, wherein the strip is made of stretchable material.

9. A kit as claimed in claim 6, wherein each form further defines a convex ledge in the lower portion of the interior surface to push up the breast.

10. A strapless, backless bra comprising:

a bra cup made of soft plastic foam molded to have an exterior surface and an interior surface, the exterior surface having a generally rounded breast-like shape and the interior surface forming a pocket in the upper portion to receive a breast and a shelf-like supporting ledge to lift and support a breast on the bottom portion and the bra cup further forming a thin top half-circular wall and a half-circular bottom edge; and an adhesive strip having a main layer, an adhesive layer and a protective cover, the main layer constructed of a stretchable wrinkle-resistant material and having a top edge, a bottom edge having a rounded central tip and tab portions extending transversely to the top edge, the adhesive layer having the same shape as the main layer and adhering to one side of the main layer, the protective cover covering the adhesive layer until the adhesive strip is used wherein:

the adhesive strip may be applied to partially overlay the bra cup and the wearer's skin around the bottom edge of the bra cup to attach the bra cup to the wearer's breast.

* * * * *